US005975290A

United States Patent [19]

Lowe

[11] Patent Number: 5,975,290

[45] Date of Patent: Nov. 2, 1999

[54] PROTECTIVE HOLDER FOR HAIR CUTTING ACCESSORIES

[76] Inventor: Harold C. Lowe, 1200 Eagle Rock La., Charlotte, N.C. 28214

[21] Appl. No.: 09/031,429

[22] Filed: Feb. 26, 1998

[51] Int. Cl.[6] ..... A45C 11/26

[52] U.S. Cl. ..... 206/234; 206/370; 206/38; 383/38; 383/40

[58] Field of Search ..... 206/38, 349, 354, 206/370, 438, 351, 234; 383/38, 39, 40

[56] References Cited

U.S. PATENT DOCUMENTS

| | | | |
|---|---|---|---|
| 2,804,969 | 9/1957 | Barnett | 206/38 |
| 3,254,787 | 6/1966 | Braun | 206/351 |
| 3,562,905 | 2/1971 | Rakocy et al. | 206/351 |
| 4,383,565 | 5/1983 | Denmat | 206/316.1 |
| 4,704,001 | 11/1987 | Parandes | 206/316.1 |
| 5,574,253 | 11/1996 | Golob et al. | 206/351 |

FOREIGN PATENT DOCUMENTS

| | | | |
|---|---|---|---|
| 0472005 | 2/1929 | Germany | 206/38 |
| 0244741 | 5/1947 | Switzerland | 206/38 |

*Primary Examiner*—Jacob K. Ackun
*Assistant Examiner*—J. Mohandesi

[57] ABSTRACT

A new protective holder for hair cutting accessories for protecting blades and guards of hair clippers. The inventive device includes a panel having a generally rectangular configuration. The panel has opposed long side edges and opposed short end edges. The panel includes an upper section and a lower section. The upper section and the lower section each have a plurality of pockets formed thereon. The pockets each have a slotted opening for receiving hair cutting accessories within the pockets. The opposed short end edges each have fasteners disposed inwardly thereof for engagement together when the panel is disposed in a folded orientation.

2 Claims, 3 Drawing Sheets

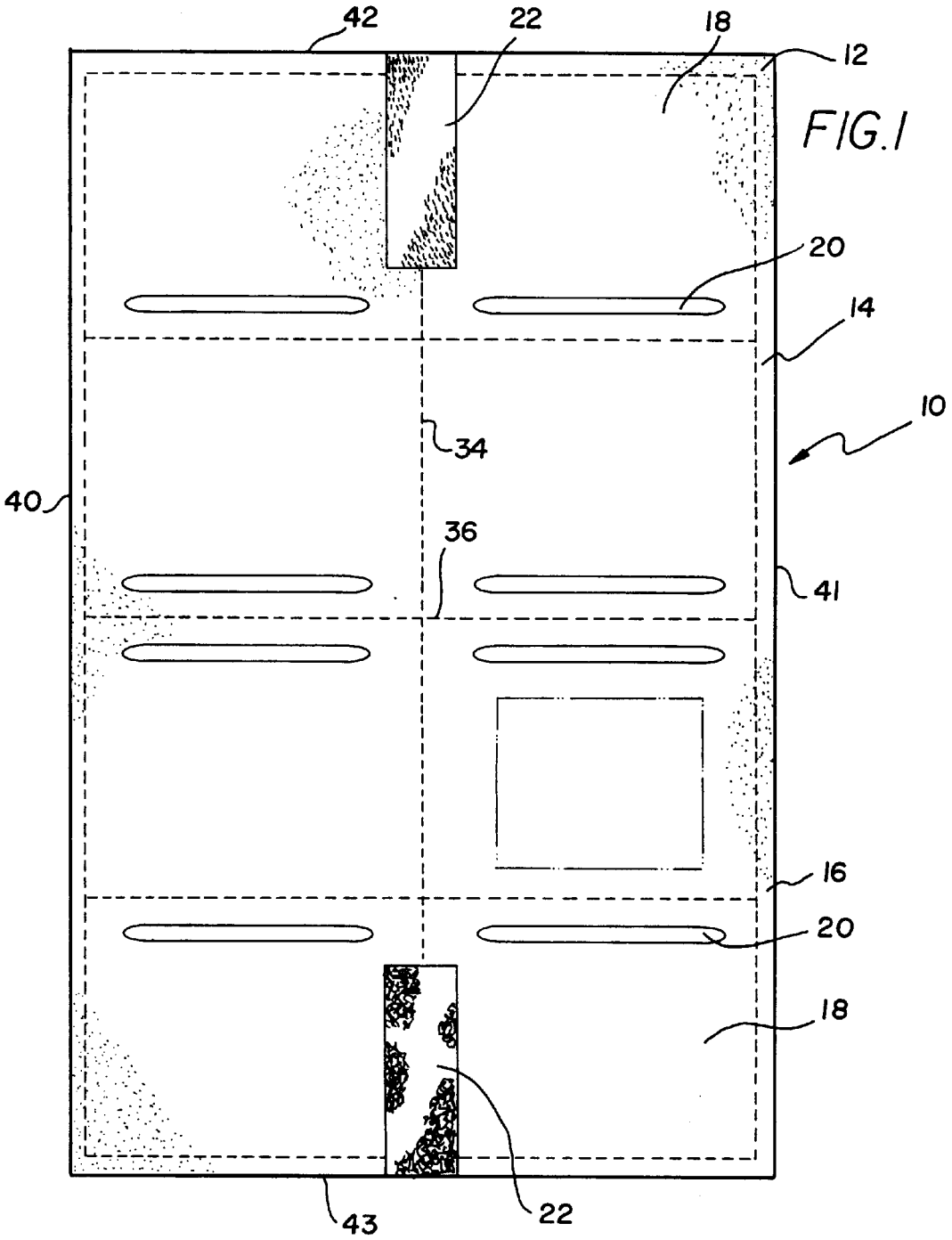
FIG.1
FIG.2
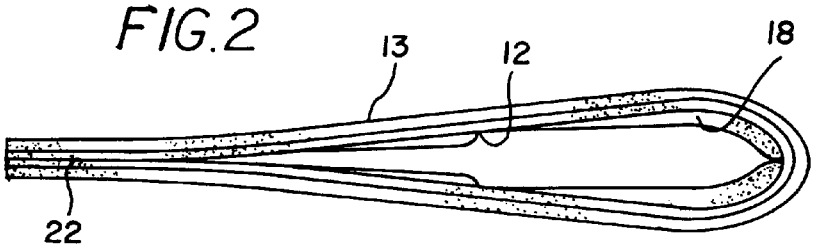

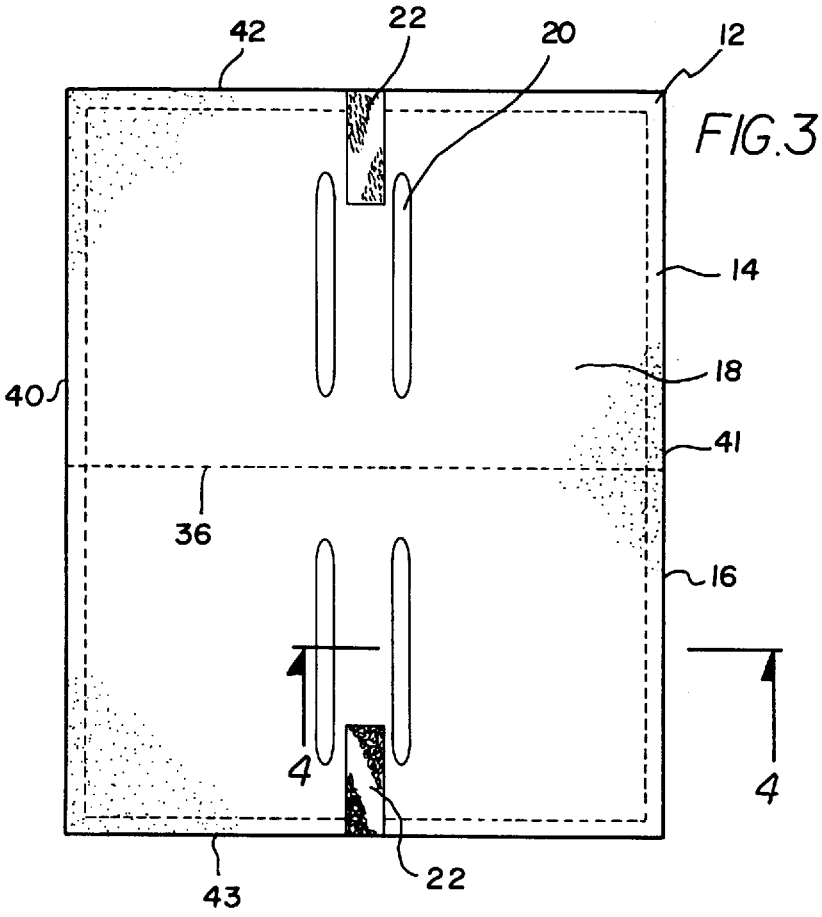
FIG.3
FIG.4
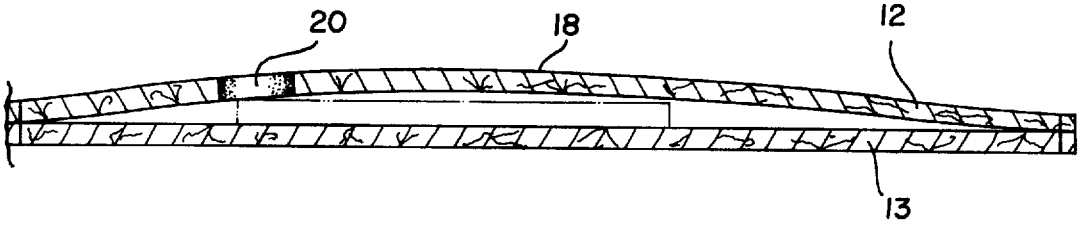

32
26
32
24
30
28

PROTECTIVE HOLDER FOR HAIR CUTTING ACCESSORIES

BACKGROUND OF THE INVENTION

1. Field of the Invention

The present invention relates to storage devices and more particularly pertains to a new protective holder for hair cutting accessories for protecting blades and guards of hair clippers.

2. Description of the Prior Art

The use of storage devices is known in the prior art. More specifically, storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art storage devices include U.S. Pat. No. 5,199,743 to Rosinski, III; U.S. Pat. No. 4,949,843 to Stokes; U.S. Pat. No. Des. 337,654 to Galvin; U.S. Pat. No. 5,429,265 to Maire et al.; U.S. Pat. No. 5,421,498 to Menoni; and U.S. Pat. No. 4,226,039 to Young.

While these devices fulfill their respective, particular objectives and requirements, the aforementioned patents do not disclose a new protective holder for hair cutting accessories. The inventive device includes a panel having a generally rectangular configuration. The panel has opposed long side edges and opposed short end edges. The panel includes an upper section and a lower section. The upper section and the lower section each have a plurality of pockets formed thereon. The pockets each have a slotted opening for receiving hair cutting accessories within the pockets. The opposed short end edges each have fastening means disposed inwardly thereof for engagement together when the panel is disposed in a folded orientation.

In these respects, the protective holder for hair cutting accessories according to the present invention substantially departs from the conventional concepts and designs of the prior art, and in so doing provides an apparatus primarily developed for the purpose of protecting blades and guards of hair clippers.

SUMMARY OF THE INVENTION

In view of the foregoing disadvantages inherent in the known types of storage devices now present in the prior art, the present invention provides a new protective holder for hair cutting accessories construction wherein the same can be utilized for protecting blades and guards of hair clippers.

The general purpose of the present invention, which will be described subsequently in greater detail, is to provide a new protective holder for hair cutting accessories apparatus and method which has many of the advantages of the storage devices mentioned heretofore and many novel features that result in a new protective holder for hair cutting accessories which is not anticipated, rendered obvious, suggested, or even implied by any of the prior art storage devices, either alone or in any combination thereof.

To attain this, the present invention generally comprises a panel having a generally rectangular configuration. The panel has opposed long side edges and opposed short end edges. The panel includes an upper section and a lower section. The upper section and the lower section each have four pockets formed thereon. The four pockets each have a horizontally oriented slotted opening for receiving hair cutting accessories within the pockets. The slotted openings of the upper section are disposed on lower ends of the pockets. The slotted openings of the lower section are disposed on upper ends of the pockets. The opposed short end edges each have a hook and loop strip disposed inwardly thereof for engagement together when the panel is disposed in a folded orientation. A clipper holder is provided that is dimensioned for holding a pair of clippers therein. The clipper holder has a cylindrical configuration. The clipper holder has an open upper end, a closed lower end, and a cylindrical side wall therebetween. The open upper end has a pair of diametrically opposed hook and loop strips disposed on an interior surface thereof for closing the open upper end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective holder for hair cutting accessories apparatus and method which has many of the advantages of the storage devices mentioned heretofore and many novel features that result in a new protective holder for hair cutting accessories which is not anticipated, rendered obvious, suggested, or even implied by any of the prior art storage devices, either alone or in any combination thereof.

It is another object of the present invention to provide a new protective holder for hair cutting accessories which may be easily and efficiently manufactured and marketed.

It is a further object of the present invention to provide a new protective holder for hair cutting accessories which is of a durable and reliable construction.

An even further object of the present invention is to provide a new protective holder for hair cutting accessories which is susceptible of a low cost of manufacture with regard to both materials and labor, and which accordingly is then susceptible of low prices of sale to the consuming public, thereby making such protective holder for hair cutting accessories economically available to the buying public.

Still yet another object of the present invention is to provide a new protective holder for hair cutting accessories which provides in the apparatuses and methods of the prior art some of the advantages thereof, while simultaneously overcoming some of the disadvantages normally associated therewith.

Still another object of the present invention is to provide a new protective holder for hair cutting accessories for protecting blades and guards of hair clippers.

Yet another object of the present invention is to provide a new protective holder for hair cutting accessories which includes a panel having a generally rectangular configuration. The panel has opposed long side edges and opposed short end edges. The panel includes an upper section and a lower section. The upper section and the lower section each have a plurality of pockets formed thereon. The pockets each have a slotted opening for receiving hair cutting accessories within the pockets. The opposed short end edges each have fastening means disposed inwardly thereof for engagement together when the panel is disposed in a folded orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of a new protective holder for hair cutting accessories according to the present invention.

FIG. 2 is a side view of the present invention illustrated in a folded orientation.

FIG. 3 is a front view of a second embodiment of the present invention.

FIG. 4 is a cross-sectional view of the present invention as taken along line 4—4 of FIG. 3.

DESCRIPTION OF THE PREFERRED EMBODIMENT

Figure 5:
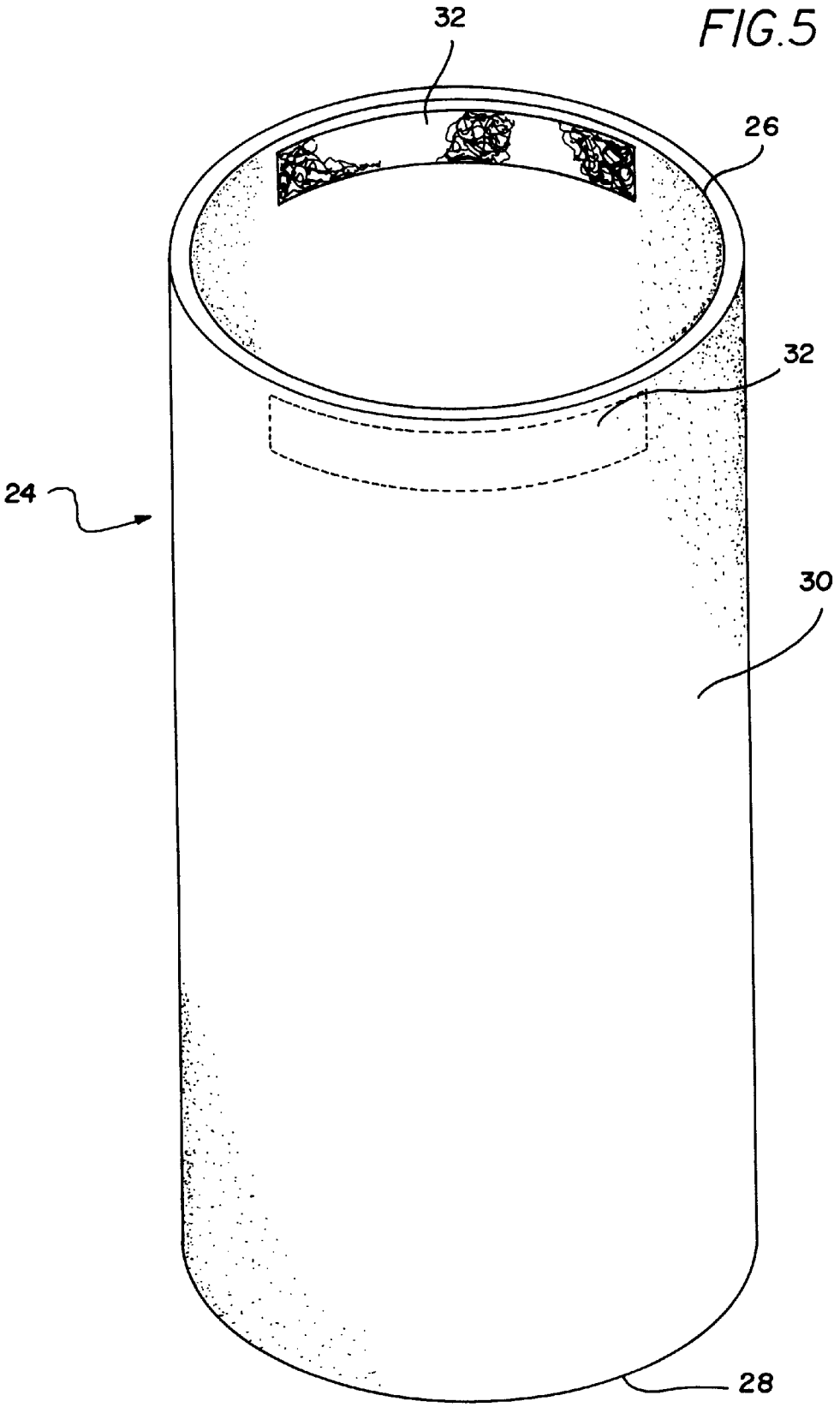
FIG. 5 is a perspective view of the clipper holder of the present invention.

With reference now to the drawings, and in particular to FIGS. 1 through 5 thereof, a new protective holder for hair cutting accessories embodying the principles and concepts of the present invention and generally designated by the reference numeral 10 will be described.

As best illustrated in FIGS. 1 through 5, the protective holder for hair cutting accessories 10 comprises inner 12 and outer 13 panels each a generally rectangular configuration. The panels 12, 13 are preferably of a leather construction, although less expensive models could be produced. The panels 12, 13 have opposed long side edges and opposed short end edges. Each of the panels 12, 13 has a first centerline 34 extending parallel to the opposed long side edges 40, 41 at a central location between the long side edges 40, 41. Further, each of the panels 12, 13 has a second centerline 36 extending parallel to the opposed short end edges 42, 43 at a central location between the short end edges. The inner 12 and outer 13 panels are coupled together along the first 34 and second 36 centerlines. The panel 12 includes an upper section 14 and a lower section 16. The upper section 14 of each of the panels 12, 13 extends between the second centerline 36 of the respective panel and one of its short end edges 42, and the lower section 16 is located opposite the upper section 14 between the second centerline 36 and the other of its short end edges 43. The upper section 14 and the lower section 16 each have four pockets 18 formed thereon. The four pockets 18 each have a horizontally oriented slotted opening 20 for receiving hair cutting accessories within the pockets 18. The slotted openings 20 of the upper section 14 are disposed parallel to the second centerline 36 oriented parallel to the short end edges 42, 43 (and parallel to each other) and are disposed on lower ends of the pockets 18. The slotted openings 20 of the lower section 16 are disposed on upper ends of the pockets 18. Thus, when the panel 12 is folded in half, note FIG. 2, the slotted openings 20 of the upper section 14 will be aligned with the slotted openings 20 of the lower section 16 thereby positioning the slotted openings 20 towards the fold at the second centerline 36 for trapping and preventing the hair cutting tools from falling out of the pockets 18 while being transported. The opposed short end edges each have a hook and loop strip 22 disposed inwardly thereof for engagement together when the panel 12 is disposed in a folded orientation. In an alternate embodiment, as illustrated in FIGS. 3 and 4, the slotted openings 20 are vertically oriented on two pockets 18 disposed on each of the upper and lower sections 14,16.

A clipper holder 24 is provided that is dimensioned for holding a pair of clippers therein. The clipper holder 24 has a cylindrical configuration. The clipper holder 24 has an open upper end 26, a closed lower end 28, and a cylindrical side wall 30 therebetween. The open upper end 26 has a pair of diametrically opposed hook and loop strips 32 disposed on an interior surface thereof for closing the open upper end 26.

In use, the present invention is a holder that would provide a protective sheath for blades and guards for clippers used in the hairdressing trade. The present invention would effectively protect a hair stylist's or barber's tools, which would increase their effective use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective holder for hair cutting accessories for protecting blades and guards of hair clippers comprising, in combination:

a first accessory holder comprising resiliently deformable inner and outer panels, each of the panels having a generally rectangular configuration and being coupled together along outer peripheries thereof, each of the panels having opposed long side edges and opposed short end edges, each of the panels having a first centerline extending parallel to the opposed long side edges at a central location between the long side edges each of the panels having a second centerline extending parallel to the opposed short end edges at a central location between the short end edges, the inner and outer panels being coupled together along the first and second centerlines, each of the panels including an upper section extending between the second centerline of the respective panel and one of its short end edges and a lower section opposite the upper section between the second centerline and the other of its short end edges, the upper section and the lower section of the inner panel each having a plurality of rows of stitching coupling the inner panel to the outer panel and forming four pockets, the four pockets each having a horizontally oriented slotted opening for receiving hair cutting accessories within the pockets, the slotted openings of the upper section being positioned towards and spaced from lower ends of the pockets, the slotted openings of the lower section being positioned towards and spaced from upper ends of the pockets, each of the pockets having substantially the same inner area, the slotted openings being aligned generally parallel each other, the opposed short end edges each having a hook and loop strip disposed inwardly thereof for engagement together when the panel is disposed in a folded orientation;

a second accessory holder comprising resiliently deformable inner and outer panels, each of the panels having a generally rectangular configuration and being coupled together along outer peripheries thereof, each of the panels having opposed long side edges and opposed short end edges, each of the panels having a first centerline extending parallel to the opposed long side edges at a central location between the long side edges, each of the panels having a second centerline extending parallel to the opposed short end edges at a central location between the short end edges, the inner and outer panels being coupled together along the first and second centerlines, each of the panels including an upper section extending between the second centerline of the respective panel and one of its short end edges and a lower section opposite the upper section between the second centerline and the other of its short end edges, the upper section and the lower section of the inner panel each having a pocket formed therein, the pockets each having a pair of vertically oriented slotted opening for receiving hair cutting accessories within the pockets, each of the pockets having substantially the same inner area, the slotted openings being aligned generally parallel each other, the opposed short end edges each having a hook and loop strip disposed inwardly thereof for engagement together when the panel is disposed in a folded orientation; and a clipper holder dimensioned for holding a pair of clippers therein, the clipper holder having a cylindrical configuration, the clipper holder having an open upper end, a closed lower end, and a cylindrical side wall therebetween, the open upper end having a pair of diammetrically opposed hook and loop strips disposed on an interior surface thereof for closing the open upper end.

2. A protective holder for hair cutting accessories for protecting blades and guards of hair clippers comprising, in combination:

a first accessory holder comprising resiliently deformable inner and outer panels, each of the panels having a generally rectangular configuration and being coupled together along outer peripheries thereof, each of the panels having opposed long side edges and opposed short end edges, each of the panels having a first centerline extending parallel to the opposed long side edges at a central location between the long side edges, each of the panels having a second centerline extending parallel to the opposed short end edges at a central location between the short end edges, the inner and outer panels being coupled together along, the first and second centerlines, each of the panels including an upper section extending between the second centerline of the respective panel and one of its short end edges and a lower section opposite the upper section between the second centerline and the other of its short end edges, the upper section and the lower section of the inner panel each having a plurality of rows of stitching coupling the inner panel to the outer panel and forming a plurality of pockets each of the pockets having a slotted opening for receiving hair cutting accessories within the pockets, the opposed short end edges each having a hook and loop strip disposed inwardly thereof for engagement together when the panel is disposed in a folded orientation;

wherein the slotted openings of the pockets are disposed parallel to the second centerline oriented parallel to the short end edges;

wherein the slotted openings of the upper section are disposed on lower ends of the pockets and the slotted openings of the lower section are disposed on upper ends of the pockets such that folding of the first accessory holder along the second centerline positions the slotted openings towards the fold at the second centerline for trapping any items held in the pockets; and wherein the slotted openings are aligned generally parallel to each other.

* * * * *